US007383791B2

(12) United States Patent
Franke et al.

(10) Patent No.: US 7,383,791 B2
(45) Date of Patent: Jun. 10, 2008

(54) CONTINUOUS STEAM GENERATOR AND METHOD FOR OPERATING SAID CONTINUOUS STEAM GENERATOR

(75) Inventors: Joachim Franke, Altdorf (DE); Rudolf Kral, Stulin (DE)

(73) Assignee: Siemens Aktiengesellschaft, Munich (DE)

( * ) Notice: Subject to any disclaimer, the term of this patent is extended or adjusted under 35 U.S.C. 154(b) by 152 days.

(21) Appl. No.: 10/570,651

(22) PCT Filed: Jul. 29, 2004

(86) PCT No.: PCT/EP2004/008526

§ 371 (c)(1),
(2), (4) Date: Mar. 3, 2006

(87) PCT Pub. No.: WO2005/028955

PCT Pub. Date: Mar. 31, 2005

(65) Prior Publication Data

US 2007/0034167 A1 Feb. 15, 2007

(30) Foreign Application Priority Data

Sep. 3, 2003 (EP) ..... 03020021

(51) Int. Cl.
*F22B 35/10* (2006.01)

(52) U.S. Cl. ..... 122/406.4; 122/451 S; 122/1 B

(58) Field of Classification Search ..... 122/1 B, 122/406.1, 406.4, 451 S
See application file for complete search history.

(56) References Cited

U.S. PATENT DOCUMENTS 3,254,631 A * 6/1966 Taylor ..... 122/7 R
4,072,182 A * 2/1978 Cheng ..... 122/406.4
5,159,897 A 11/1992 Franke et al.
5,189,988 A * 3/1993 Budin et al. ..... 122/6 A
5,588,400 A 12/1996 Stefan et al.
5,735,236 A * 4/1998 Kastner et al. ..... 122/6 A
5,924,389 A * 7/1999 Palkes et al. ..... 122/7 R
6,092,490 A * 7/2000 Bairley et al. ..... 122/7 R
6,173,679 B1 * 1/2001 Bruckner et al. ..... 122/406.4
2004/0149239 A1 * 8/2004 Franke et al. ..... 122/406.4

FOREIGN PATENT DOCUMENTS

DE 736 611 C1 6/1943
DE 11 22 082 B1 1/1962
DE 29 50 622 A1 10/1981
DE 41 26 631 A1 2/1993
DE 44 41 008 A1 5/1996

* cited by examiner

*Primary Examiner*—Gregory Wilson

(57) ABSTRACT

The invention relates to a continuous steam generator wherein an evaporator throughflow heating surface is disposed in a gas duct which can be cross flown in an approximately vertical manner in a heating gas device, said evaporator throughflow heating surface comprising a plurality of parallel connected steam generating pipes enabling a flow medium to flow through, also enabling particularly high operating stability and security during the supply of the flow medium having a comparatively high mass flow density. The inventive evaporator throughflow heating surface comprises a heating surface segment which can be cross-flown by the flow medium in an opposite direction to the gas duct, the flow medium side exit is positioned in such a manner that it can be seen in the heating direction of the gas such that the saturated steam generator which is adjusted during operation according to pressure in the evaporator throughflow heating surface deviates by less than a maximum predetermined amount from the heating gas temperature prevailing during operation at the position of the exit of the heating surface segment.

4 Claims, 1 Drawing Sheet

CONTINUOUS STEAM GENERATOR AND METHOD FOR OPERATING SAID CONTINUOUS STEAM GENERATOR

CROSS REFERENCE TO RELATED APPLICATION

This application is the US National Stage of International Application No. PCT/EP2004/008526, filed Jul. 29, 2004 and claims the benefit thereof. The International Application claims the benefits of European Patent application No. 03020021.6 EP filed Sep. 03, 2003, both of the applications are incorporated by reference herein in their entirety.

FIELD OF THE INVENTION

The invention relates to a continuous-flow steam generator in which an evaporator throughflow heating surface is disposed in a gas duct through which heating gas can flow in an approximately vertical direction, said evaporator heating surface comprising a number of steam-generating pipes connected in parallel for a flow medium to flow through.

BACKGROUND OF THE INVENTION

In a gas and steam turbine installation, the heat contained in the expanded working medium or heating gas is used for generating steam for the steam turbine. The transfer of heat is carried out in a waste-heat steam generator connected downstream of the gas turbine, in which waste-heat steam generator a number of heating surfaces are usually disposed for preheating water, for generating steam and for superheating steam. The heating surfaces are connected to the water-steam circuit of the steam turbine. The water-steam circuit usually comprises multiple, e.g. three, pressure stages, whereby each pressure stage can have an evaporator heating surface.

Multiple alternative layout concepts may be considered for the steam generator connected as a waste-heat steam generator downstream of the gas turbine on the heating-gas side, namely a layout as a continuous-flow steam generator or a layout as a circulation steam generator. In a continuous-flow steam generator, the heating of steam-generating pipes provided as evaporator pipes leads to an evaporation of the flow medium in the steam-generating pipes in a single pass. In contrast to this, in a natural-circulation or forced-circulation steam generator, the circulated water is only partially evaporated in one pass through the evaporator pipes. The water which is not evaporated is, following separation of the generated steam, fed into the same evaporator pipes again for further evaporating.

In contrast to a natural-circulation or forced-circulation steam generator, a continuous-flow steam generator is not subject to any pressure limitation, so live-steam pressures far above the critical pressure of water ($P_{Cri}$≈221 bar)—where there are only small differences in density between a liquid-like and a steam-like medium—are possible. A high live-steam pressure promotes a high thermal efficiency and consequently low $CO_2$ emissions in a fossil-fuel fired power station. Also, a continuous-flow steam generator has, in comparison with a circulation steam generator, a simple design and can consequently be produced at particularly low cost. The use of a steam generator, designed in accordance with the continuous-flow principle, as a waste-heat steam generator in a gas and steam turbine installation is therefore particularly suitable for achieving a high degree of overall efficiency of the gas and steam turbine installation with a simple design.

Such a waste-heat steam generator can be technically implemented particularly easily where the heating gas supplied to the steam generator from the gas turbine flows through the gas duct in a vertical direction, in particular from bottom to top. In principle, two possible designs can be considered for the flow-medium and heating-gas connections of the steam-generating pipes which form the evaporator throughflow heating surface: either the flow medium flows through the steam-generating pipes laid inside the gas duct in a cross-flow or counterflow, i.e. the flow medium flows through each heating surface pipe in successive passes through the gas channel across the gas flow, hence the name cross-flow circuit. The horizontal pipe elements leading from one side of the gas channel to the other side are connected to one another via redirecting elements in such a manner that the flow passes through them in succession in a vertical direction counter to the direction of flow of the gas, hence the name counterflow circuit. Overall, it is thus a mixed form of cross-flow and counterflow circuit. The cross-flow character is immaterial to the arguments below. This circuit will therefore be referred to below only as a counterflow circuit. It is generally known that an evaporator heating surface in a counterflow circuit is problematical in terms of the stability of the flow. In particular, an even distribution of the flow over all the parallel pipes of the evaporator heating surface requires a technical outlay.

An alternative to the counterflow circuit is provided by the so-called parallel-flow circuit, in which the flow through the steam-generating pipes is a cross/parallel flow. In this circuit, the horizontally routed pipe elements are connected to one another, as in the previously described cross-flow circuit, via redirecting elements, except that now the flow passes through them in succession in a vertical direction, in the direction of flow of the gas, hence the name parallel-flow circuit. Overall, this is thus a mixed form of cross- and parallel-flow circuit. The cross-flow character is immaterial to the arguments below. This circuit will therefore be referred to below only as a parallel-flow circuit. A parallel-flow circuit necessitates the use of comparatively large heating surfaces, the production and assembly of which involve a substantial outlay.

From EP 0 425 717 A, a steam generator is known which has the specified advantages of a continuous-flow steam generator. Its evaporator throughflow heating surface is designed as a combination of counterflow and cross-flow circuit, in that a number of pipe sections are connected in a counterflow direction, while a number of further pipe sections are connected in a parallel-flow direction. This type of circuitry enables a greater degree of flow stability to be achieved than in the case of a pure counterflow circuit. Also, the high outlay required on equipment and apparatus where a pure counterflow circuit is used can be reduced.

A fundamental problem in steam generators of this type of design can be temperature distortions, that is temperature differences at the outlets of adjacent steam-generating pipes connected in parallel on the flow-medium side, which can lead to pipe bursts or other damage. In order to avoid such temperature distortions, continuous-flow steam generators can be designed for particularly low mass-flow densities of the flow medium. However, this limits flexibility in the choice of design parameters for the steam generator.

SUMMARY OF THE INVENTION

The object of the invention is therefore to indicate a continuous-flow steam generator of the above-mentioned type which exhibits a particularly high stability, especially against temperature distortions, even where comparatively large mass flow densities of the flow medium are applied and where the steam-generating pipes are heated to differing degrees. Furthermore, a particularly suitable method of the aforementioned type for operating this steam generator will be indicated.

With regard to the continuous-flow steam generator, this object is achieved according to the invention in that the evaporator throughflow heating surface comprises a first heating-surface segment through which the flow medium can flow in counterflow relative to the gas duct and a further heating-surface segment connected upstream of the heating-surface segment on the flow-medium side and on the heating-gas side, the flow-medium-side outlet of the first heating-surface segment, viewed in the direction of the heating gas, being positioned such that the saturated-steam temperature which is adjusted during operation in the evaporator throughflow heating surface deviates by less than a maximum predetermined amount of at most 70° C. from the heating-gas temperature prevailing during operation at the position of the outlet of the heating-surface segment.

The invention is based upon the consideration that, when the evaporator throughflow heating surface is supplied with comparatively large mass-flow densities, locally differing heating of individual pipes could affect the flow conditions such that less flow medium flows through pipes which are heated more and more flow medium flows through pipes which are heated less. Pipes heated more would in this case be cooled less well than pipes heated less, so any temperature differences arising would automatically be intensified. In order to be able to tackle such a case effectively without actively influencing the flow conditions, the system should be designed for a fundamental and comprehensive limitation of possible temperature differences. To this end, use can be made of the finding that at the outlet from the evaporator throughflow heating surface, the flow medium has to have at least the saturated-steam temperature determined essentially by the pressure in the steam-generating pipe. On the other hand, however, the flow medium can at most have the temperature which the heating gas has at the outlet point of the flow medium from the evaporator throughflow heating surface. Through appropriate coordination of these two threshold temperatures which delimit any possible temperature interval that there may be, the maximum possible temperature distortions can consequently also be limited appropriately. Subdivision of the evaporator throughflow heating surface into an outlet-side counterflow segment and a further segment connected upstream thereof on the heating-gas and flow-medium side enables the outlet to be positioned freely in the direction of the heating gas so that an additional design parameter is available. A particularly suitable means for coordinating the two threshold temperatures with one another is the deliberate positioning of the outlet of the evaporator throughflow heating surface in the direction of flow of the heating gas.

Advantageously, the positioning of the outlet of the evaporator throughflow heating segment in relation to the temperature profile of the heating gas in the gas duct is chosen such that a maximum deviation of approximately 50° C. is observed so that, with regard to available materials and further design parameters, a particularly high operational safety is ensured.

A further problem in a steam generator of the specified design could be the risk to flow stability posed by flow oscillations. Flow oscillations arise when, in the event of the additional heating of one steam-generating pipe, the area inside the steam-generating pipe in which evaporation takes place shifts significantly within the pipe. The displacement of the evaporation area inside a steam-generating pipe affects the pressure loss of the flow inside the evaporator throughflow surface in an undesired manner. Therefore, in a steam generator which responds so sensitively to a deviation in the heating of the steam-generating pipes, throttles could be provided at the inlet of all steam-generating pipes, said throttles making it possible to control the pressure loss of the flow inside the evaporator throughflow heating surface across a comparatively large range. In order also to provide suitable design parameters for this, the evaporator throughflow heating surface advantageously comprises the further heating-surface segment, connected upstream of the specified heating-surface segment on the flow-medium side, which on the heating-gas side is also disposed upstream of the specified heating-surface segment.

The further heating-surface segment connected upstream on the flow-medium side is advantageously also configured in the manner of a counterflow section or alternatively connected in parallel flow relative to the direction of the heating gas.

Such an arrangement of the segments in the heating-gas channel largely retains the advantage of a pure counterflow circuit in transferring the heat of the waste gas effectively to the flow medium and at the same time achieves a high degree of intrinsic protection against harmful temperature differences at the flow-medium-side outlet.

The steam generator is usefully used as a waste-heat steam generator in a gas and steam turbine installation. The steam generator here is advantageously connected downstream of a gas turbine on the heating-gas side. In this circuit, an additional furnace for raising the temperature of the heating gas can usefully be arranged downstream of the gas turbine.

With regard to the method, the specified object is achieved in that, viewed in the direction of the heating gas, the flow medium is conducted away from the evaporator throughflow heating surface at a position at which the heating-gas temperature prevailing during operation deviates by less than a maximum predetermined amount of at most 70° C. from the saturated-steam temperature adjusted during operation as a consequence of the pressure loss in the evaporator throughflow heating surface.

The flow medium is advantageously conducted, prior to its outlet from the evaporator throughflow heating surface, in a counterflow relative to the heating gas. In the corresponding heating-surface segment, the flow medium flows through the steam-generating pipes counter to the direction of the heating gas, i.e. from top to bottom. Where the evaporator throughflow heating surface is supplied in such a manner, the positioning of the outlet can be varied comparatively easily and adapted to the temperature profile of the heating gas in the gas duct. Advantageously, a maximum deviation of approximately 50° C. is predetermined.

The advantages achieved by means of the invention are in particular that the overall temperature interval achievable in the evaporation of the flow medium between saturated-steam temperature of the flow medium and heating-gas temperature at the outlet point is comparatively narrowly delimited by means of the positioning now provided, adapted to the temperature profile of the heating gas in the gas duct, of the flow-medium-side outlet of the evaporator throughflow heating surface, so that only small temperature differences at the outlet side are possible, independently of the flow conditions. This enables adequate equalization of the temperatures of the flow medium to be ensured in every operating state. Also, the evaporator throughflow heating surface is more stable in terms of flow than a pure counterflow circuit as a result of the appropriate positioning of the flow-medium-side inlet of the evaporator throughflow heating surface at the gas-side inlet of the evaporator throughflow heating surface. Consequently, a particularly high flow stability and a particularly high operating safety are ensured for the steam generator. In addition, however, it is also ensured that the possible outlet temperatures are limited in their absolute level so that they remain safely below the admissible threshold temperatures predetermined by the material properties.

BRIEF DESCRIPTION OF THE DRAWINGS

An exemplary embodiment of the invention will be explained below with the aid of drawings, in which.

DETAILED DESCRIPTION OF THE INVENTION

The same reference symbols are used to label the same parts in the two Figures.

Figure 1:
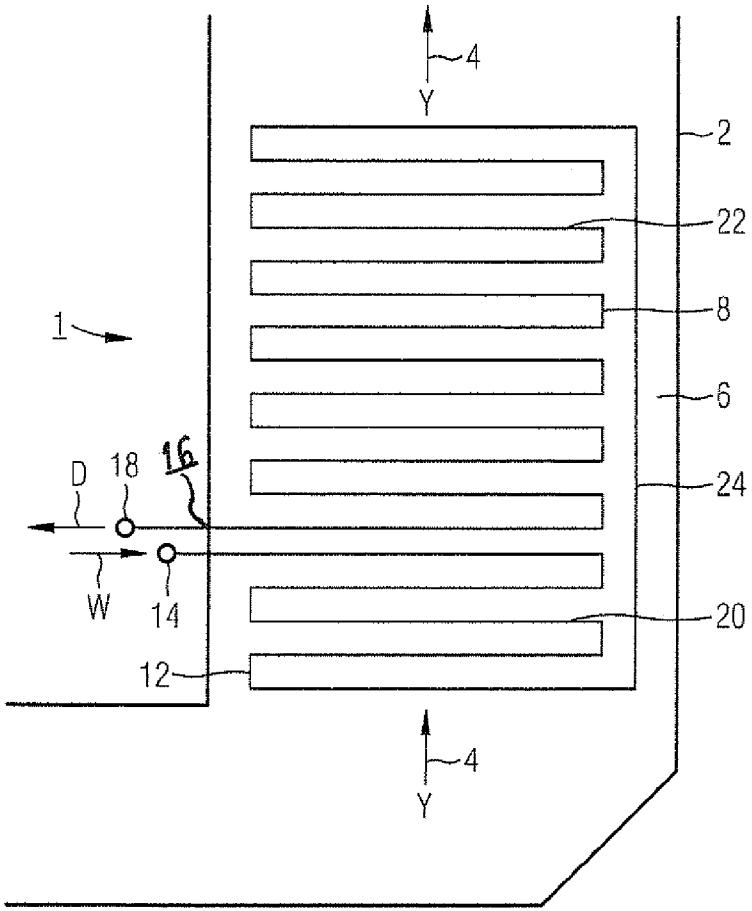
FIG. 1 shows in simplified representation a detail of a continuous-flow steam generator in longitudinal section

The continuous-flow steam generator 1 according to FIG. 1 is connected in the manner of a waste-heat steam generator on the waste-gas side downstream of a gas turbine, not shown in detail. The continuous-flow steam generator 1 has an enclosing wall 2 which forms a gas duct 6, through which heating gas can flow in a nearly vertical direction y indicated by the arrows 4, for the waste gas out of the gas turbine. A number of heating surfaces laid out according to the continuous-flow principle, in particular an evaporator throughflow heating surface 8, are disposed in the gas duct 6. In the exemplary embodiment according to FIG. 1, only the evaporator throughflow heating surface 8 is shown. However, a larger number of throughflow heating surfaces can also be provided.

Flow medium W can be admitted to the evaporator system formed from the evaporator throughflow heating surface 8, said flow medium evaporating upon a single pass through the evaporator throughflow heating surface 8 and being conducted away as steam D after exit from the evaporator throughflow heating surface 8 and normally being supplied to superheater heating surfaces for further superheating. The evaporator system formed from the evaporator throughflow heating surface 8 is connected to the water-steam circuit (not shown in detail) of a steam turbine. In addition to the evaporator system, a number of further heating surfaces not shown in FIG. 1 are connected to the water-steam circuit of the steam turbine. The heating surfaces can, for example, be superheaters, medium-pressure evaporators, low-pressure evaporators and/or preheaters.

The evaporator throughflow heating surface 8 of the continuous-flow steam generator 1 according to FIG. 1 comprises, in the manner of a pipe assembly, a plurality of steam-generating pipes 12, connected in parallel, for the flow medium W to flow through. Here, a plurality of steam-generating pipes 12 are respectively arranged next to one another, viewed in the heating-gas direction y. Only one of the steam-generating pipes 12 arranged next to one another in this way is visible in each case. The steam-generating pipes 12 respectively comprise a number of pipe elements through which a flow passes horizontally, two of which are respectively connected by a pipe element through which a flow passes vertically. In other words, the steam-generating pipes are respectively laid meander-like inside a gas duct 6. A shared inlet header 14 is connected upstream of the steam-generating pipes 12 arranged next to one another in this manner on the flow-medium side at their inlet 13 into the evaporator throughflow heating surface 8 and a shared outlet header 18 is connected downstream of said steam-generating pipes 12 at their outlet 16 from the evaporator throughflow heating surface 8.

The continuous-flow steam generator 1 is designed for a particularly high operating safety and for consistently suppressing significant temperature differences, also called temperature distortions, at the outlet 16 between adjacent steam-generating pipes 12, even where supplied with comparatively high mass flow densities. To this end, the evaporator throughflow heating surface 8 comprises a heating-surface segment 20 in its rear area, viewed from the flow-medium side, which heating-surface segment is connected in counterflow relative to the heating-gas direction y. Furthermore, the evaporator throughflow heating surface 8 comprises, in addition to the heating-surface segment 20, a further heating-surface segment 22 connected upstream of this on the flow-medium side. By means of this connection, the positioning of the outlet 16, viewed in the heating-gas direction, can be selected. This positioning is selected in the continuous-flow steam generator 1 such that the saturated-steam temperature of the flow medium W which is adjusted during operation according to the pressure in the evaporator throughflow heating surface 8 deviates by less than a maximum predetermined amount of approximately 50° C. from the heating-gas temperature prevailing during operation at the position of or at the level of the outlet 16 of the heating-surface segment 20. Since the temperature of the flow medium W at the outlet 16 has always to be at least equal to the saturated-steam temperature, but cannot on the other hand be higher than the heating-gas temperature prevailing at this point, the possible temperature differences between differently heated pipes are limited, even without further countermeasures, to the maximum predetermined deviation of approximately 50° C.

A particularly high flow stability, simultaneously involving a limited technical outlay, can also be achieved through the use of a combination of counterflow connection and parallel-flow connection of the steam-generating pipes. The first heating-surface segment 20 is connected here to the second heating-surface segment 22 by means of a connection element 24. The evaporator throughflow heating surface 8 comprises the further heating-surface segment 22, the connection element 24 connected downstream of this on the flow-medium side and the heating-surface segment 20 connected downstream of the connection element on the flow medium side. In the exemplary embodiment according to FIG. 1, the further heating-surface segment 22 is also connected in counterflow relative to the heating-gas direction 4.

Figure 2:
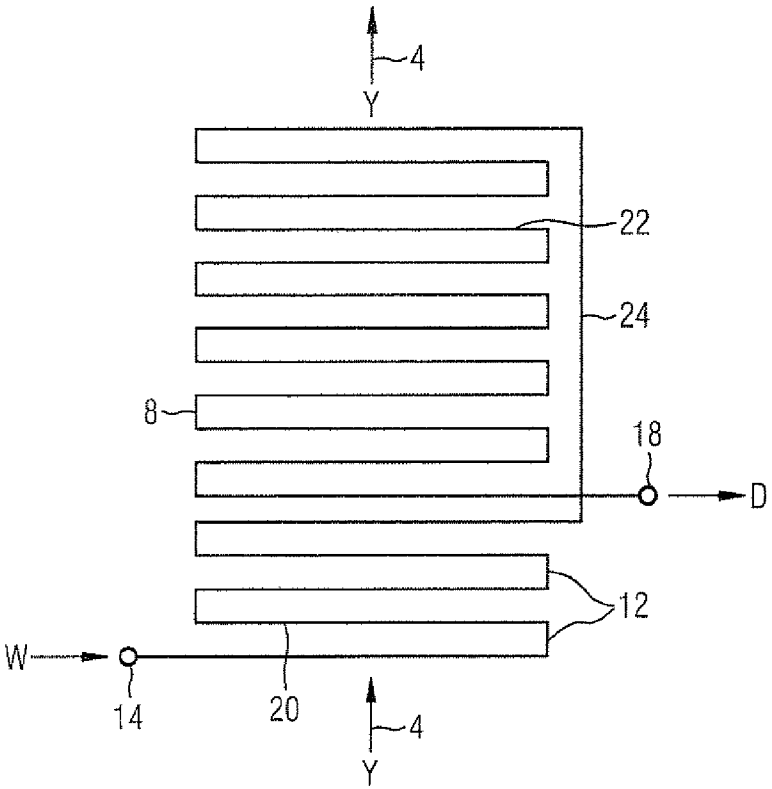
FIG. 2 shows the evaporation section of the continuous-flow steam generator according to FIG. 1 in an alternative design

It has emerged that both the connection of the evaporator throughflow heating surface 8 shown in FIG. 1 and the alternative connection of the evaporator throughflow heating surface 8 shown in FIG. 2 have a particularly high flow stability. In particular, the occurrence of flow oscillations is also safely prevented. These occur when a deviating heating of individual steam-generating pipes 12 shifts the evaporation area inside the steam-generating pipe 12 concerned considerably along the direction of flow of the flow medium W. Flow oscillations can be avoided in such a case, whereby the pressure loss occurring in the flow medium W when flowing through the evaporator throughflow heating surface 8 is artificially increased by means of throttles at the inlet of the pipes. In the circuits shown in FIG. 1 and FIG. 2, the problem of flow oscillations does not, however, arise. It has been shown that in the case of a deviation in heating there is only a comparatively small shift of the evaporation area inside the respective steam-generating pipe 12. In order to stabilize the flow, only a low artificial increase in the pressure loss is therefore required.

The invention claimed is:

1. A method for operating a continuous-flow steam generator, comprising:

providing an evaporator throughflow heating surface in a gas duct through which heating gas flows in an approximately vertical direction, the evaporator throughflow heating surface comprising a number of steam generating pipes connected in parallel for a flow medium to flow through, wherein the flow medium viewed in the heating-gas direction is conducted away from the evaporator throughflow heating surface at a position at which the heating-gas temperature prevailing during operation deviates by less than a predetermined maximum amount of at most 70° C. from the saturated-steam temperature which is adjusted during operation as a result of the pressure loss in the evaporator throughflow heating surface.

2. The method according to claim 1, wherein the flow medium is conducted in a counterflow relative to the heating gas immediately upstream of its outlet from the evaporator throughflow heating surface.

3. The method according to claim 1, wherein the flow medium is conducted in a counterflow relative to the heating gas immediately downstream of its inlet to the evaporator throughflow heating surface.

4. The method according to claim 1, wherein the flow medium is conducted in a parallel flow relative to the heating gas immediately downstream of its inlet to the evaporator throughflow heating surface.

* * * * *